US006613192B1

(12) United States Patent
Bajpai et al.

(10) Patent No.: US 6,613,192 B1
(45) Date of Patent: Sep. 2, 2003

(54) PROCESS FOR PRODUCING BIOKRAFT PULP FROM EUCALYPTUS CHIPS

(75) Inventors: Pratima Bajpai, Patiala (IN); Pramod K. Bajpai, Patiala (IN); Masood Akhtar, Madison, WI (US)

(73) Assignees: Biopulping International, Inc., Madison, WI (US); Thapar Centre for Industrial Research & Development, Pratalia (IN)

( * ) Notice: Subject to any disclaimer, the term of this patent is extended or adjusted under 35 U.S.C. 154(b) by 0 days.

(21) Appl. No.: 09/646,256

(22) PCT Filed: Mar. 18, 1998

(86) PCT No.: PCT/US98/05101

§ 371 (c)(1),
(2), (4) Date: Nov. 28, 2000

(87) PCT Pub. No.: WO99/46444

PCT Pub. Date: Sep. 16, 1999

(51) Int. Cl.[7] ..... D21C 3/02; D21H 25/02

(52) U.S. Cl. ..... 162/72; 162/82; 435/277; 435/278

(58) Field of Search ..... 162/72, 9, 65, 162/78, 82; 435/277, 278

(56) References Cited

U.S. PATENT DOCUMENTS

| | | | | |
|---|---|---|---|---|
| 3,962,033 | A | 6/1976 | Eriksson et al. | |
| 5,055,159 | A | 10/1991 | Blanchette et al. | |
| 5,460,697 | A | 10/1995 | Akhtar et al. | |
| 5,750,005 | A | 5/1998 | Akhtar | |
| 5,851,351 | A | * 12/1998 | Baecker et al. | 162/72 |

FOREIGN PATENT DOCUMENTS

WO WO 96/05362 A1 2/1996

OTHER PUBLICATIONS

Akhtar, et al., "Biomechanical Pulping of Loblolly Pine With Different Strains of the White–Rot Fungus *Ceriporiopsis Subvermispora", Tappi J.*, Feb. 1992, pp. 105–109.

Bar–Lev, et al., "Fungal Treatment Can Reduce Energy Requirements for Secondary Refining of TMP", *Tappi J.*, Oct. 1982, pp. 111–113.

Blanchette, R., "Screening Wood Decayed by White Rot Fungi for Preferential Lignin Degradation", *Applied and Environmental Microbiology*, Sep. 1984, pp. 647–653.

Lawson, L. and Still, C., "The Biological Decomposition of Lignin—Literature Survey", *Tappi J.*, vol. 40, No. 9, Sep. 1957, pp. 56A–80A.

Myers, et al., "Fungal Pretreatment of Aspen Chips Improves Strength of Refiner Mecahnical Pulp", *Tappi J.*, May 1988, pp. 105–108.

Leatham, et al., "Energy Savings in Biomechanical Pulping", *4th International Conference*, Raleigh, NC, May 16–19, 1989.

Leatham, et al., "Biomechanical Pulping of Aspen Chips: Paper Strength and Optical Properties Resulting from Different Fungal Treatments", *Tappi J.*, Mar. 1990, pp. 249–255.

Leatham, et al., "Biomechanical Pulping of Aspen Chips: Energy Savings Resulting from Different Fungal Treatments", *Tappi J.*, May 1990, pp. 197–200.

Oriaran, et al., "Kraft Pulp and Papermaking Properties of *Phanerochaete Chrysosporium*–degraded Aspen", *Tappi J.*, Jul. 1990, pp. 147–152.

Yang, et al., "Bleaching of Softwood Kraft Pulps with the EnZone Process", *Tappi J.*, vol. 77 No. 3, See Abstract, Mar. 1994, pp. 243–250.

Akhtar, M., Attridge, M.C., Myers, G.C. and Blanchette, R.A. "Biomechanical Pulping of Loblolly Pine Chips with Selected White–Rot Fungi", *Holzforschung*, 1993, 47(1), 36–40.

Ander, P. and Eriksson, K.E. "Mekanisk massa från förrötad flis—en inledande undersökning", *Svensk Papperstidning*, 1975, 18, 641.

Blanchette, R.A. and Burnes, T.A., "Selection of White–Rot Fungi for Biopulping", *Biomass*, 1988, 15, 93–101.

Eriksson, K.E. and Vallander, L., "Properties of Pulps from Thermomechanical Pulping of Chips Pretreated with Fungi", *Svensk Paperstidning*, 1982, 85(6), R33–R38.

Labosky Jr., P., Zhang, J. and Royse, D.J., "Lignin Biodegradation of Nitrogen Supplemented Red Oak (*Quercus Rubra*) Wood Chips with Two Strains of *Phanerochaete Chrysosporium", Wood and Fiber Sci.*, 1991, 23, 533–542.

Messner, K., Masek, S., Srebotnik, E. and Techt, G., "Fungal Pretreatment of Wood Chips for Chemical Pulping", *Biotechnology in the Pulp and Paper Industry, Proceedings of the 5th International Conference on Biotechnology in the Pulp and Paper Industry* (Kuwahara, M. and Shimada, M., eds.) 1992, pp. 9–13.

Oriaran, T. Ph., Labosky Jr., P. and Blankenhorn, P.R., "Kraft Pulp and Papermaking Properties of *Phanerochaete Chrysosporium* Degraded Red Oak", *Wood and Fiber Sci.*, 1991, 23, 316–327.

Scott, G.M., Akhtar, M., Lentz, M., Sykes, M. and Abubakr, S., "Biosulfite Pulping Using *Ceriporiopsis Subvermispora"*, (Srebotnik, E., Messner, K. eds.), Facultas–Universitats Verlag, Bergasse 5, A–1090 Wien, Austria, 1996, p. 217–219.

Wolfaardt, J.F., Boshoff, I.E., Bosman, J.L., Rabie, C.J. and van der Westhuizen, G.C.A., "Lignin Degrading Potential of South African Wood–Decay Fungi", *FEMS Symposium, Lignin Biodegradation and Transformation, Book of Proceedings* (Duarte, J.C., Ferreira, M.C. and Ander, P., Eds.), Forbitec Editions, Lisboa. 1993, pp. 67–69.

(List continued on next page.)

*Primary Examiner*—Steve Alvo
(74) *Attorney, Agent, or Firm*—Michael Best & Friedrich LLP; Grady J. Frenchick; Jeffrey D. Peterson

(57) ABSTRACT

A method for producing paper pulp for use in the making of paper from eucalyptus wood chips. The method comprises inoculating wood chips with white rot fungi, fermenting the wood chips so as to cause a propagation of the fungus through the wood chips and allowing the fungus to modify the lignin, and pulping the degraded wood chips by a kraft process.

15 Claims, No Drawings

OTHER PUBLICATIONS

Wolfaardt, J.F., Bosman, J.L., Jacobs, A., Male, J.R. and Rabie, C.J., "Bio–Kraft Pulping of Softwood", *Proceedings of the 6th International Conference on Biotechnology in the Pulp and Paper Industry: Advances in Applied and Fundamental Research* (Srebotnik, E., Messner, K. eds.), Facultas–Universitats Verlag, Bergasse 5, A–1090 Wien, Austria, 1996, p. 211–216.

Akhtar, M., et al., "The White–Rot Fungus *Ceriporiopsis Subvermispora* Saves Electrical Energy and Improves Strength Properties During Biomechanical Pulping of Wood", *Proceedings of the 5th International Conference on Biotechnology in the Pulp and Paper Industry*, Kyoto Japan, May 27–30, 1992, p. 3–8.

Akhtar, M., et al., "Toward Commercialization of Biopulping", *PaperAge*, Feb. 1999, p. 1–4.

Scott, G.M., Akhtar, M., Lentz, M., Sykes, M., and Abukar, S. 1995. In *Proceedings of the 1995 Environmental Conference*, pp. 1155–1161, Atlanta: Tappi Press.

* cited by examiner

PROCESS FOR PRODUCING BIOKRAFT PULP FROM EUCALYPTUS CHIPS

FIELD OF THE INVENTION

This invention relates to a method for producing paper pulp for use in the making of paper.

BACKGROUND OF THE INVENTION

In the manufacture of paper from wood, the wood is first converted to pulp. Pulping involves treating wood to separate the cellulose fibers. Pulping processes are divided into two broad classes: chemical pulping and mechanical pulping. Chemical pulping involves the use of chemicals to solubilize the lignin in the wood cell wall and to release cellulose fibers. Lignin is a natural glue-like material that holds the wood cell wall together. Chemical pulping is a low yield process (about 50%) with significant waste treatment and chemical recycling costs; however, the pulp produced has extremely high strength properties. Mechanical pulping involves the use of mechanical force to separate cellulose fibers. Mechanical processes are high yield (up to 95%) but give paper with lower strength properties, high color reversion and low brightness. Thus, currently available pulping processes offer a spectrum of pulp properties ranging from high yield, low strength mechanical pulps to low yield, high strength chemical pulp. A mixture of chemical pulp and mechanical pulp is used in many paper production processes to exploit these differences.

It has been suggested that biological systems can be also used to assist in the pulping of the wood. Attempts to improve primary pulp production processes by using isolated ligninolytic enzymes have so far been inhibited by the complex chemistry of the ligninolytic enzyme system, low yields in enzyme production and the ultrastructure of wood itself. White rot fungi, however, have great potential for this application. These fungi not only produce the whole set of enzymes necessary for lignin degradation but also act as a transport system for these enzymes by bringing them into the depth of wood chips and create the physiological conditions necessary for enzymatic reactions. Some of the white rot fungi are relatively selective for lignin and in that way their action mimic that of chemical pulping agents. It is these selective lignin degrading fungi which are useful for biopulping.

The use of white rot fungi for the biological delignification of wood was first studied at the West Virginia Pulp and Paper Company (now Westvaco) in the 1950s (Lawson and Still, 1957). In the 1970s Eriksson and coworkers at STFI demonstrated that fungal treatment could result in significant energy savings for mechanical pulping (U.S. Pat. No. 3,962,033, 1976; Ander and Eriksson, 1975; Eriksson and Vallander, 1982). Two sequential biopulping consortia comprised of the USDA Forest Products Laboratory (FPL), the Universities of Wisconsin and Minnesota, and 22 pulp and paper and allied companies have established the techno-economic feasibility of biopulping in connection with mechanical refining (Akhtar et al., 1992a,b, 1993, Blanchette et al., 1984, 1988, Leatham et al., 1989, 1990a,b, 1990, Myers et al., 1988). Four U.S. patents have been granted to the Wisconsin Alumni Research Foundation (WARF) (U.S. Pat. Nos. 5,055,159,1991; 5,460,697, 1994; PCT Int. Appl. WO9605362 A 1 February 1996, U.S. patent Ser. No. 08/801,704 now U.S. Pat. No. 5,750,005, File No. 960296.94339).

The effect of fungal pretreatment on chemical pulp production has been investigated to a much lesser extent. On biosulfite pulping, some work has been done in Austria and at FPL, U.S.A. However, detailed studies have not been carried out. Messner et al. (1992) reported ~30% reduction in kappa number in 2 weeks in case of birch and spruce. The brightness of the unbleached pulp increased by 4 ISO points. However, the strength properties deteriorated. Scott et al. (1996) reported about 48 and 21% reduction in kappa number (residual lignin in pulp) in 2 weeks with *Ceriporiopsis subvermispora* strains CZ-3 and SS-3 respectively during calcium acid sulfite pulping. However, the effect of fungal treatment on brightness and strength properties of the pulp were not examined. Also, the bleaching response of the fungal-treated pulp was not seen.

On biokraft pulping, some work has been done at FPL, U.S.A. and other laboratories on pine, aspen and red oak. Wolfaardt et al. (1993, 1996) reported about 18% reduction in kappa number at mill conditions, when pine wood was treated with white rot fungi. However, under all the tested conditions, yield and viscosity was lower and the alkali consumption was higher. Oriaran et al. (1990) reported that glucose supplemented aspen chips pretreated with white rot fungi led to kappa number reduction of 3 and 9% in 20 and 30 days respectively. A marked decrease in beating time was observed only after an incubation period of 30 days, while in the same period the water retention value increased from 102% to 137% and the fines also increased. However, the brightness of unbleached pulp decreased drastically by 62%. Tensile strength increased by 21% after 30 days, while the tear index decreased. Results obtained with red oak were similar to those obtained with aspen (Oriaran, 1991; Lobosky, 1991). A systematic literature survey has shown that no work has been done on biokraft pulping of eucalyptus. To the best of our knowledge, this is the first report where positive results on biokraft pulping have been obtained.

The present invention deals with a method for biokraft pulping of eucalyptus. It involves partial degradation/modification of eucalyptus wood with white rot fungi followed by kraft pulping of the treated wood. It has been found that pretreatment with white rot fungi improves chemical pulping efficiency and pulp properties (brightness and strength). Treated wood chips could be pulped in a shorter cooking time or could alternatively be used to produce pulp using lower active alkali charge or sulfidity. The bleached biopulps are easier to refine than the reference pulp.

SUMMARY OF THE INVENTION

An object of this invention is to provide a novel method for producing paper pulp for use in the making of paper by fungal treatment.

Another object of this invention is to provide a method for producing paper pulp for use in the making of paper which avoids or reduces the nutrient requirements during fungal treatment of wood chips.

Still another object of this invention is to provide a method for producing paper pulp for use in the making of paper which requires less amount of chemicals in comparison to conventional kraft pulping and consequently reduced effluents.

It is another object of the present invention to provide a method for producing paper pulp for use in the making of paper having higher strength.

Yet another object of the present invention is to provide a method for producing paper pulp for use in the making of paper and wherein the cooking time is reduced.

Other objects and advantages of the present invention will be more apparent from the ensuing description.

According to this invention there is provided a method for producing pulp from eucalyptus pulp for use in the making of paper comprising in the steps of:

a) inoculating eucalyptus wood chips with white rot fungi;

b) incubating the wood chips so as to cause a propagation of the fungus through the wood chips and allow the fungus to modify lignin; and c) pulping of the degraded wood chips by a known kraft process;

In another embodiment, the foregoing steps are augmented by the further step of bleaching the kraft pulp by conventional bleaching processes. It will be further recognized that the eucalyptus chips biotreated by the metabolic activity of the white rot fungi during incubation are themselves a commodity of commerce which may be utilized directly in a kraft process, or transported to another location for kraft pulping at a time remote from the initial big treatment step.

DETAILED DESCRIPTION OF THE PREFERRED EMBODIMENT

The present invention deals with the biological pretreatment of wood chips for making of chemical pulp, for manufacture of paper. It has been particularly found that through the use of white rot fungi and the maintenance of suitable conditions during the treatment of wood chips by white rot fungi, it is possible to utilize a biological treatment or pretreatment as a part of chemical pulping (kraft) process on eucalyptus which is a major raw material for manufacture of paper in many countries. It has been found that the process results in shorter cooking time or chemical savings and energy savings and also results in a paper which has a higher strength than that made from purely kraft pulping process. The experimental evidence presented makes it clear that the procedure is efficacious and efficient and enables the creation of commercial scale procedures for implementing the general process described herein.

This process makes use of white rot fungi. The particular species of fungus found to be useful is *C. subvermispora*. However, other white rot fungi can also be used. Strains of *C. subvermispora* can be maintained by conventional fungal culture techniques most conveniently by growing on potato-dextrose-agar (PDA) slants. Stock slants may routinely be prepared from an original culture for routine use and may be refrigerated until used. The particular strain of *C. subvermispora* utilized in the examples below, L-14807-SS-3 was obtained from the Center for Mycology Research, Forest Products Laboratory, Madison, Wis. It was found that the particular fungi described herein was particularly well-suited for biokraft pulping application (Tables 1–4). However, other white rot fungi-*Hyphodontia setulosa, Phlebia subserialis, Phlebia brevispora, Phlebia tremellosa, Phanerochaete chrysosporium* and other strains of *C. subvermispora*-CZ-3, L-9186-SP, FP-105732, FP-105752-SS5, have also been found to be suitable for the present invention (Tables 5–13).

The process of the present invention is intended and particularly adapted for the biopulping of eucalyptus. The wood is converted to chips through a conventional technology. Wood chips are heat treated, preferably with steam, to disable but not necessarily sterilize the chips prior to inoculation with the fungus. The moisture content in the chips is kept at fiber saturation point or greater. A preferred moisture content would be approximately 50–55% of the total wood based on wet weight basis of the chips.

Fungi are preferably applied to the wood as follows. To inoculate significant volumes of wood chips, a starter inoculum may be prepared. PDA plates are inoculated from PDA slants and incubated at 27±1° C. and 70–90% relative humidity. These plates are used to inoculate 1 liter Erlenmeyer flasks containing potato dextrose broth and yeast extract. The inoculated flasks are incubated without agitation in an incubator at 27±1° C. and 70–90% relative humidity for 7–10 days. The surface of the medium is covered with the fungus in the form of mat. The fungal mat is removed from the medium, washed with sterilized water on sterilized buchner funnel to remove all the medium. The fungal mat is transferred into a sterile waring blender with sterile forceps and blended with sterile water. This suspension is used to inoculate wood chips. Scaling up the foregoing culture steps for preparing the fungal inoculation involves preparation of media in commercial scale vats, and growth of fungi in commercial scale fermenters. Using industrial scale equipment, fungal cultures in 500–1500 gallon batches are readily obtainable.

Fungal treatment of wood chips is carried in bioreactor which may be any of a number of styles capable of handling solid media fermentation culture. It is merely required that the stationary or solid phase reactor have sufficient aeration so as to ensure adequate $O_2$ flow to the fungus and significant removal of $CO_2$ therefrom. In fact, it is an advantage of the process that it can be conducted in static fermentation procedure without the need for an exotic or moving fermenting chamber thereby allowing the process to be used more practically on a large scale. Simply some level of aeration, humidity and temperature control is required. On an industrial scale, the inoculated chip mass may be incubated in cylindrical silos or in open chip piles of 20–200 tons, under nonstick conditions, provided proper ventilation is maintained, as discussed more fully hereafter.

For the fungal treatment, wood chips are put in the bioreactor, autoclaved and cooled to room temperature, or exposed to steam to disable native microorganism populations without absolute sterilization. The wood chips to be treated are inoculated with starter culture. The amount of inoculum added to the chips can vary. It should be sufficient to ensure growth and spread to all chips in the bioreactor. Inoculum level of 1 to 5 gm per ton of wood chips was found to be sufficient. The chips so inoculated will then be incubated during a time period in which the fungal mycelia will penetrate throughout the wood chips. It has been found that nutrients are not required during fungal treatment of eucalyptus wood chips. Addition of nutrients does not give additional biopulping benefits but result in more loss in the weight of wood chips and unbleached pulp yield. The most desired temperature range depends on the fungal strains.

It has been found that a bioreactor kept in the range of 27±2° C. with a moisture content in the wood of 55–65% achieves a great degree of mycelia penetration of wood chips that results in significant degradation of wood chips for paper pulping process. The wood chips are aerated continuously during the incubation period with the air saturated with moisture that the wood maintains the constant moisture content of about 55–65%. It has been found that under the conditions used experimentally, an incubation period of 1 to 3 weeks results in significant modification of the wood chips and reduction in cooking time or chemicals requirement and energy savings in the subsequent chemical (kraft) pulping process.

The biologically degraded wood chips are then subjected to chemical pulping (kraft) process. The treated chips could be cooked in shorter time or require less chemicals during cooking and less energy during refining. The biokraft pulps made through this procedure is then bleached in a multistage bleaching process and made into paper using standard paper-making techniques. Paper made from biokraft pulp is better in quality, strength and texture to that created through simple kraft pulping process.

Effective biopulping can be carried out under nonsterile conditions in which naturally occurring flora are present and viable. However, better results are obtained with steamed or autoclaved wood chips. Eucalyptus wood chips are exposed to live steam resulting in elevating their surface temperature to about 90° to 100° C., as measured immediately after steam treatment. The exposure time is a function of the temperature of the superheated vapor and also the inlet pressure. While 101° to 108° C. influent steam at 15 to 75 in line psi for exposure times of 3 to 50 seconds is adequate, the optimum values are best determined in a few empirical process runs for the particular type and configuration of equipment, as hereinafter described in more detail.

The chamber in which steam treatment takes place should not be too tightly packed. Open space of about under 10% to over 65% of the volume capacity is sufficient to allow penetration of steam to all chip surfaces provided that the chips can be mechanically turned or agitated to prevent impeded exposure to steam at touching surfaces. For example, in the screw conveyor used in a preferred embodiment of the invention, the open space above the chips in the conveyor was found to be approximately 57% to 69%. (In addition, the void space between the chips amounted to approximately 61%. Therefore, the total void space in the conveyor amounted to approximately 83% (large chips) to 88% (small chips). Uniformity of steam treatment is very important, as the naturally occurring flora must be uniformly disabled or biosuppressed physiologically to avoid spots of overgrowth by contaminants during the subsequent incubation step.

A particularly efficient method of steam treatment is by injecting steam into a continuous flow screw or auger bearing the chips at about 30% to 45% spacial density as discussed above. It was found that exposure time of chips adequate for the present process could be only 40 seconds compared to 5–10 minutes in a quiescent batch mode. Steam was released at moderate pressure and applied ambiently without pressurizing the vessel.

A number of species of contaminating organisms can readily be isolated from moistened wood chips including Aspergillis spp., Colletotrichum spp., Trichoderma spp., Gliocladium spp., Ophiostoma spp., Penicillium spp., Ceratocystis spp., Nectria spp., Cytospora spp., and Alternaria spp. Many of these are more physiologically robust and faster growing than the inoculating lignin-degrading or modifying fungi of choice. Growth of these organisms is also enhanced in many instances by the nutrient adjuvants contained in the fungal inoculum. Therefore, addition of such nutrients is avoided.

Once the indigenous, undesirable microbes are disabled or suppressed by steam treatment, the less robust and more fastidious white-rot fungi in the inoculum are able to remain dominant over extended periods. The disabled organisms are still viable and capable of becoming dominant, as shown by biopulping runs in which the treatment temperature was inadvertently allowed to rise only to suboptimal levels. In those instances the runs were ruined by overgrowth of the contaminating fungi. Clearly a highly delicate but controllable process balance must be maintained, but it is unclear scientifically what competitive factors are at work to maintain the desired biological balance over extended incubations. Reducing exposure to steam to a minimum without sterilization also has favorable implications for process costs. The low exposure time conductive to a continuous treatment means that high volume treatment required in any commercial scale process is attainable in the present invention.

In the next step of the process, the chips must be cooled sufficiently to permit inoculation of the biopulping fungi without killing or disabling them. Many of the useful species may actually be more sensitive to elevated temperatures than their naturally occurring flora counterparts. Chips steam treated on a continuously moving path are passed through heat transfer means which cool the chips to an appropriate temperature for inoculation. Applicants have found that the most cost effective and simplest method is to place an in-line air blower manifold directly in the conveyance path, and adjust the air flow to a rate that will cool the passing chips adequately.

It has been determined empirically that chips cooled to about 40°–45° C. and as high as 50° C. are cool enough not to heat shock the fungi contained in the inoculum. The highest temperature tolerated by biopulping organisms may vary from species to species, so that some empirical tests may be necessary to determine a physiologically suitable temperature for inoculation of that species. Cooling only to the highest physiologically suitable temperature minimizes the cooling time and speeds the process, and reduces the energy consumed.

Inoculation of the biopulping fungi is preferably carried out in-line, and applied as a liquid spray to the passing wood chips. As in the steam treatment, the working action of agitated conveyor or auger allows inoculum to be uniformly adsorbed onto the chip surfaces by tumbling and churning during rotary or other agitated conveyance. It is important that the inoculum be applied substantially thoroughly and uniformly to the chip surfaces. If the biopulping fungi are to maintain dominance over other flora, the contaminating flora should not be given a sufficient opportunity to reestablish themselves in local areas of the chip surfaces where coverage of inoculum is uneven.

The enzymatic breakdown or modification of lignin by fungi is an exothermic reaction, so that when a large mass of chips is undergoing delignification, a substantial concentration of heat ensues. As the surface area of the mass of chips diminishes relative to the total mass, the problem intensifies since wood itself is an excellent heat insulator. The most practical way to dissipate heat in the chips to prevent the temperature from exceeding the level at which the biopulping fungi are killed, and the contaminants begin to overgrow the fungi, is by forcing air through the chips.

It has been found that the temperature of chip piles can be adequately controlled and maintained at levels biocompatible with the continued propagation and dominance of the fungus by loading the chips onto an air pervious frame defining a plurality of ducts through which forced air is passed. It has been empirically determined that the humidity of the air should be in a range from at least 30% up to over 95% relative humidity, preferably about 85%, and the flow rate should be adjusted seasonally to maintain the temperature in the core of the pile within the active growth range of the fungus, which must be determined for each species. In the case of *C. subvermispora*, the range is approximately 27° to 32° C.

After inoculation, the chips may be conveniently collected in large piles. Temperature and humidity control are important for optimal fungal propagation and lignin degradation or modification. It has been determined that practical control can be maintained for piles loaded onto the bottom frame referred to above having dimensions about 40–55 feet high, 100 feet wide and any length. Two 400 foot long piles can accommodate a pulp plant utilizing 600 tons of chips daily. To obtain proper humidity, wet bulb/dry bulb tests can be performed on the influent air. Relative humidity should preferably be maintained at about 70%–90%. Humidification of air by conventional means such as fogging prior to pumping or fanning into the frame ducts is generally necessary. The amount of heat generated in the pile generally requires continuous dissipation by forced air flow even during the winter months in the northern climes.

Incubation times are related to the degree of lignin digestion or modification desired, the type of wood chips being handled, and the particular fungus or combination of fungi being utilized in the process. Useful periods of incubation range from a few days to four weeks. On the other hand, prolonged incubation results in larger standing inventories of chips and larger on site storage capacity.

Tubular reactors (silo reactors) can also be used for biopulping. This silo reactor has a large-scale (multiton) capacity. A perforated plate at the bottom of the reactor supports the chips approximately 5 cm above the bottom of the reactor. Air is supplied to this void space at the bottom center of the reactor. A baffle plate immediately above the air inlet distributes the air more evenly across the bottom of the reactor.

Approximately 160 kg of chips (dry basis) were decontaminated by steaming, as noted above. After cooling (typically overnight), the chips were inoculated using a protocol involving mixing of the inoculum in a large rotating "V" mixer or by auger. The inoculated chips are then transferred to the silo reactor via auger. The chips are ventilated with nearly saturated moist air with the velocity adjusted to maintain the proper temperature range throughout the reactor.

The details of the process of the present invention will become more apparent from the following examples which describe the laboratory-scale utilization of the present process and the results achieved thereby.

EXAMPLES

1. Biokraft Pulping of Eucalyptus With *C. subvermispora* at the Same Active Alkali Charge In this example, *C. subvermispora* L-14807-SS-3 culture which was maintained on PDA slant was used. Working culture was prepared from the stock culture for routine use. For inoculum preparation, PDA plate cultures were inoculated from the working stock culture. The plate cultures were incubated at 27±1° C. at 70–90% relative humidity for 7–10 days. These plates were used to inoculate 1 liter Erlenmeyer flasks containing 100 ml of liquid medium which contained 36 g of potato dextrose broth and 10.91 g of yeast extract in 1500 ml water. The inoculated flasks were incubated without agitation in an incubator at 27±1° C. and 70–90% relative humidity for 10 days. The surface of the medium was covered with the fungus in the form of mat. The fungal mat was removed from the medium, washed with sterilized water to remove all the medium. The fungal mat was transferred into a sterile waring blender with sterile forceps. About 50 ml of sterile water was added to the blender and the mycelium was blended for 15 seconds. The fungal suspension was transferred to a beaker and diluted to 100 ml by adding sterile water. This suspension was used to inoculate wood chips. 1500 gm (o.d. basis) of eucalyptus wood chips were put in aerated static bed bioreactor and autoclaved at 121° C. for 60 min. and cooled to room temperature. About 7.5 mg (dry wt.) of the fungus (5 g dry wt. of the fungus per ton of material) was added to 1500 gm of wood chips in the bioreactor and mixed thoroughly. The moisture content of chips was adjusted to 50–55%. The bioreactor was incubated in a room temperature varying between 27–32° C. The bioreactor was aerated with humidified air at a rate of 1 cubic ft. per hour. After incubation for 2 weeks, the fungal-treated wood chips were removed from the bioreactor and subjected to kraft pulping in bomb digesters. The conditions for the kraft cooks were 17% active alkali (AA) as $Na_2O$, 22.9% sulfidity, 3.0 liquor/wood ratio, 165° C. cooking temperature, 90 minutes to cooking temperature and 90 minutes at cooking temperature. The biokraft pulp was bleached in a multistage bleaching process (CEHD) sequence and made into paper.

The fungus was found to grow very well on eucalyptus chips in the bioreactor. The fungal-treated chips appeared brighter than the control chips. The weight loss of wood chips after the fungal treatment was about 2.4%. When the cooking was done at the same active alkali charge for reference chips as well as fungal-treated chips, the brightness and strength properties of unbleached biopulp were higher as compared to those of control. However, the unbleached yield of the biopulp was lower and there was no drop in the permanganate number (P.No.) of the biopulp. The unbleached brightness of biopulp was higher by more than 2 points. Tensile index and breaking length of biopulp increased by 13.8% , burst index increased by 35.7% and double fold increased by 66.6%. The unbleached yield of the biopulp decreased slightly. The bleaching response of biopulp was better than that of control. The final brightness of biopulp (CEHD sequence) was higher by 2 points. The bleached biopulp was easier to refine than the reference pulp. The beating time was reduced by 33%. The strength properties of bleached biopulp were better than those of control (Table 1).

2. Biokraft Pulsing of Eucalyptus With *C. subvermispora* at Reduced Active Alkali Charge In this example, fungal-treated chips (Inoculum level 5 g/T wood) were cooked at 14% AA charge. Even then, the unbleached brightness of biopulp was better than that of the reference pulp (no fungal treatment) obtained by cooking the chips at 17% AA charge. The strength properties of biopulp (with 14% AA charge) were substantially higher and the bleaching response was better than those of reference pulps (with 17% AA charge). When the bleaching was done under identical conditions at the same total chemical charge, the final brightness of these biopulps was higher by about 1 point in a 4-stage (CEHD) bleaching sequence. The bleached biopulps were easier to refine than the reference pulp. The beating time was reduced by ~20%. Most of the strength properties of the bleached biopulps were better than those of control (Table 2).

3. Biokraft Pulsing of Eucalyptus With *C. subvermispora* at Reduced Cooking Time In this example, fungal-treated wood chips (Inoculum level, 5 g/T wood) were cooked for shorter time as compared to reference chips. Cooking time was reduced by 16.6, 25.0 and 33.3%. The time to cooking temperature was fixed at 90 minutes and time at cooking temperature was reduced. When the cooking time was reduced by 25% and 33.3%, the control wood chips after cooking remain partially uncooked.

On the other hand, the fungal-treated chips were still uniformly cooked even with 30 minutes cooking. In all the cases, the brightness and mechanical properties of unbleached biopulps were higher and the bleaching response was better as compared to control (untreated chips cooked for 90 minutes at 165° C.). The final brightness of the biopulps in CEHD sequence was also higher as compared to control. When the cooking time was reduced by 16.6 and 25%, higher final pulp brightness was obtained at the same total chemical charge. The bleached biopulps were easier to refine than the reference pulp. The beating time was reduced by 16–18%. There was no significant difference in the strength properties of bleached biopulps and reference pulp (Table 3).

4. Biokraft Pulping of Eucalyptus With *C. subvermispora* at Reduced Sulfidity In this example, fungal-treated chips (Inoculum level, 5 g/T wood) were cooked at reduced sulfidity. The sulfidity was reduced from 22.9% to 16%. The unbleached brightness and strength properties of the fungal-treated chips at 16% sulfidity level were found to be higher than those of reference chips cooked at 22.9% sulfidity (Table 4).

References Cited

Akhtar, M., Attridge, M. C. and Myers, G. C. (1992a) Tappi J., 75(2), 105–109.

Akhtar, M., Attridge, M. C., and Blanchette, R. A. (1992b) In: Biotechnology in the pulp and paper industry (Kuwahara, M. and Shimada, M. eds.) Tokyo, UNI Publishers Company Ltd., p. 545.

Akhtar, M., Attridge, M. C., Myers, G. C. and Blanchette, R. A. (1993) Holzforschung, 47(1), 36–40.

Ander, P. and Eriksson, K. E. (1975) Svensk Papperstidning, 18, 641.

Bar-lev, S. S., Kirk, T. K. and Chang, H. M. (1982) Tappi J., 65(10), 111–113.

Blanchette, R. A. (1984) Applied & Environmental Microbiology, 48(3), 647–653.

Blanchette, R. A. and Burnes, T. A. (1988) Biomass, 15, 93–101.

Eriksson, K. E. and Vallander, L. (1982) Svensk Paperstidning, 85(6), R33–R38.

Eriksson, K. E., Ander, P., Henningsson, M. and Nilsson, T., U.S. Pat. No. 3,962,033, June 1976.

Labosky Jr., P., Zhang, J. and Royse, D. J. (1991) Wood Fiber Sci., 23, 533–542.

Lawson, L. R. and Still, C. N. (1957) Tappi J., 40, 56A–80A.

Leatham, G. F. et al., Presented at Biotechnology in the Pulp and Paper Industry, 4th International Conference, Raleigh, N.C., May 16–19, 1989.

Leatham, G. F., Myers, G. C., Wegner, T. H. and Blanchette, R. A. (1990a) Tappi J., 73(3), 249–255.

Leatham, G. F., Myers, G. C., Wegner, T. H. and Blanchette, R. A. (1990b) Tappi J., 73(5), 197–200.

Messner, K., Masek, S., Srebotnik, E. and Techt, G. (1992) In: Biotechnology in the Pulp and Paper Industry, Proceedings of the 5th International Conference on Biotechnology in the Pulp and Paper Industry (Kuwahara, M. and Shimada, M., Eds.) pp. 9–13, Uni Publishers Co. Ltd., Tokyo.

Myers, G. C., Leatham, G. F., Wegner, T. H. and Blanchette, R. A. (1988) Tappi J., 71(5), 105–108.

Oriaran, T. Ph., Labosky Jr., P. and Blankenhorn, P. R. (1990) Tappi J., 73(7), 147–152.

Oriaran, T. Ph., Labosky Jr., P. and Blankenhorn, P. R. (1991) Wood Fiber Sci., 23, 316–327.

Scott, G. M., Akhtar, M., Lentz, M., Sykes, M. and Abubakr, S. (1996) Biotechnology in the Pulp and Paper Industry: Recent Advances in Applied and Fundamental Research (Srebotnik, E., Messner, K. Ed.), Facultas-Universitats Verlag, Bergasse 5, A-1090 Wien, Austria, p. 217–219.

Wolfaardt, J. F., Boshoff, I. E., Bosman, J. L., Rabie, C. J. and van der Esthuizen, G. C. A. (1993) In: FEMS Symposium, Lignin Biodegradation and Transformation, Book of Proceedings (Duarte, J. C., Ferreira, M. C. and Ander, P., Eds.) pp. 67–69, Forbitec Editions, Lisboa.

Wolfaardt, J. F., Bosman, J. L., Jacobs, A., Male, J. R. and Rabie, C. J. (1996) Biotechnology in the Pulp and Paper Industry: Recent Advances in Applied and Fundamental Research (Srebotnik, E., Messner, K. Ed.), Facultas-Universitats Verlag, Bergasse 5, A-1090 Wien, Austria, p. 211–216.

TABLE 1

Biokraft pulping of eucalyptus with *C. subvermispora* L-14807-SS-3 at same active alkali charge[1]

a. Pulp properties

| Parameter | Treated[2] | Control |
|---|---|---|
| P. No. | 14.46 | 14.40 |
| Unbleached brightness (% PV) | 29.1 | 27.0 |
| Unbleached pulp yield (%) | 45.8 | 46.1 |
| Final brightness (% PV) | 87.2 | 85.2 |
| Bleach chemical consumption (kg/TP) | | |
| Elemental $Cl_2$ | 40.0 | 40.0 |
| NaOH | 18.8 | 18.8 |
| Hypo | 12.3 | 12.3 |
| Chlorine dioxide | 6.0 | 6.0 |

b. Strength properties

| | Unbleached | | Bleached | |
|---|---|---|---|---|
| Parameter | Control | Treated | Control | Treated |
| Wetness (° SR) | 17 | 18 | 35 | 35 |
| Beating time (min) | — | — | 30 | 20 |
| Tensile index (N m/g) | 42.15 | 47.98 | 75.51 | 82.30 |
| Breaking length (m) | 4299 | 4894 | 7702 | 8394 |
| Burst index (kN/g) | 1.93 | 2.62 | 4.59 | 5.14 |
| Tear index (mN $m^2$/g) | 5.66 | 5.48 | 6.92 | 7.20 |
| Double fold (No.) | 6 | 10 | 102 | 112 |

[1]Kraft cooking of fungal-treated chips and reference chips (no fungal treatment) conducted at 17% AA charge
[2]Fungal treatment for 2 weeks; Inoculum level, 5 g/T wood

TABLE 2

Biokraft pulping of eucalyptus with *C. subvermispora* at reduced active alkali charge a. Pulp properties

| | AA Charge (%) | | | |
|---|---|---|---|---|
| Parameter | 17 Control | 14 Treated | 14 Control | 14 Treated |
| P. No. | 13.50 | 15.86 | 16.28 | 15.86 |
| Unbleached brightness (% PV) | 27.3 | 28.3 | 25.9 | 28.3 |
| Unbleached pulp yield (% PV) | 45.67 | 45.53 | 47.15 | 45.53 |

TABLE 2-continued

Biokraft pulping of eucalyptus with *C. subvermispora* at reduced active alkali charge

| | | | | |
|---|---|---|---|---|
| Final brightness (% PV) | 87.0 | 88.3 | 87.6 | 89.1 |
| Bleach chemical consumption (kg/TP) | | | | |
| Elemental $Cl_2$ | 37.5 | 37.5 | 46.1 | 46.1 |
| NaOH | 19.1 | 19.1 | 18.9 | 18.9 |
| Hypo | 13.5 | 13.5 | 12.8 | 12.8 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 16.5 | 17.0 | 17.5 | 35.0 | 35.0 |
| Beating time (min) | — | — | — | 29.0 | 22.5 |
| Tensile index (N m/g) | 33.68 | 34.1 | 40.75 | 66.25 | 72.26 |
| Breaking length (m) | 3435 | 3478 | 4157 | 6757 | 7364 |
| Burst index (kN/g) | 1.38 | 1.62 | 1.89 | 4.30 | 4.85 |
| Tear index (mN $m^2$/g) | 5.45 | 5.77 | 6.81 | 7.68 | 7.88 |
| Double fold (No.) | 5 | 8 | 10 | 58 | 80 |

Treatment of eucalyptus with *C. subvermispora* L-14807-SS-3 for 2 weeks, Inoculum level, 5 g/T wood
Cooking of fungal-treated chips conducted at 14% AA charge; cooking of reference chips conducted at 17% and 14% AA charge

TABLE 3

Effect of fungal treatment on cooking time

1) Reduction of cooking time by 16.6% a. Pulp properties

| Parameter | Control 90 min. | Treated 60 min. | Control 60 min. | Treated 60 min. |
|---|---|---|---|---|
| P. No. | 14.66 | 15.85 | 15.66 | 15.85 |
| Unbleached brightness (% PV) | 28.0 | 29.5 | 28.9 | 29.5 |
| Unbleached pulp yield (%) | 46.0 | 44.8 | 46.5 | 44.8 |
| Final brightness (% PV) | 88.6 | 90.5 | 89.5 | 90.4 |
| Bleach chemical consumption (kg/TP) | | | | |
| Elemental $Cl_2$ | 40.9 | 40.9 | 44.0 | 44.0 |
| NaOH | 19.4 | 19.4 | 19.5 | 19.5 |
| Hypo | 19.2 | 19.2 | 19.6 | 19.6 |
| Chlorine dioxide | 5.0 | 5.0 | 5.0 | 5.0 |

b. Strength properties

| | Unbleached | | Bleached | |
|---|---|---|---|---|
| Parameter | Control 90 min. | Treated 60 min. | Control 90 min. | Treated 60 min. |
| Wetness (° SR) | 17.0 | 18.0 | 35.0 | 35.5 |
| Beating time (min) | — | — | 25.0 | 21.0 |

TABLE 3-continued

Effect of fungal treatment on cooking time

| | | | | |
|---|---|---|---|---|
| Tensile index (N m/g) | 32.22 | 36.93 | 63.09 | 64.54 |
| Breaking length (m) | 3286 | 3767 | 6435 | 6583 |
| Burst index (kN/g) | 1.42 | 1.81 | 4.05 | 4.10 |
| Tear index (mN $m^2$/g) | 5.79 | 6.00 | 7.76 | 7.20 |
| Double fold (No.) | 5 | 8 | 50 | 54 |

2) Reduction of cooking time by 25% a. Pulp properties

| Parameter | Control 90 min. | Treated 45 min. | Control 90 min. | Treated 45 min. |
|---|---|---|---|---|
| P. No. | 14.66 | 16.50 | partially un-cooked chips | 16.50 |
| Unbleached brightness (% PV) | 28.0 | 30.5 | | 30.8 |
| Unbleached pulp yield (%) | 45.9 | 44.9 | | 44.9 |
| Final brightness (% PV) | 88.6 | 90.1 | | 90.5 |
| Bleach chemical consumption (kg/TP) | | | | |
| Elemental $Cl_2$ | 40.9 | 40.9 | | 47.7 |
| NaOH | 19.2 | 19.2 | | 19.7 |
| Hypo | 19.5 | 19.5 | | 21.4 |
| Chlorine dioxide | 5.0 | 5.0 | | 5.0 |

b. Strength Properties

| | Unbleached | | Bleached | |
|---|---|---|---|---|
| Parameter | Control 90 min. | Treated 45 min. | Control 90 min. | Treated 45 min. |
| Wetness (° SR) | 17.0 | 18.0 | 35.0 | 35.0 |
| Beating time (min) | — | — | 25.0 | 21.0 |
| Tensile index (N m/g) | 32.22 | 39.89 | 63.09 | 67.94 |
| Breaking length (m) | 3286 | 3989 | 6435 | 6930 |
| Burst index (kN/g) | 1.42 | 1.91 | 4.05 | 4.20 |
| Tear index (mN $m^2$/g) | 5.79 | 5.91 | 7.76 | 7.50 |
| Double fold No.) | 5 | 7 | 50 | 60 |

3) Reduction of cooking time by 33.3% a. Pulp properties

| Parameter | Control 90 min. | Treated 30 min. | Control 30 min. | Treated 30 min. |
|---|---|---|---|---|
| P. No. | 13.81 | 16.59 | partially un-cooked chips | 16.59 |

TABLE 3-continued

| Effect of fungal treatment on cooking time | | | |
|---|---|---|---|
| Unbleached brightness (% PV) | 27.6 | 30.8 | 30.8 |
| Unbleached pulp yield (%) | 46.076 | 46.37 | 46.37 |
| Final brightness (% PV) | 88.6 | 88.71 | 90.5 |
| Bleach chemical consumption (kg/TP) | | | |
| Elemental $Cl_2$ | 38.4 | 38.4 | 46.2 |
| NaOH | 19.8 | 22.3 | 22.3 |
| Hypo | 16.2 | 16.2 | 16.3 |
| Chlorine dioxide | 6.0 | 6.0 | 6.0 |

b. Strength properties

| | Unbleached | | Bleached | |
|---|---|---|---|---|
| Parameter | Control 90 min | Treated 30 min | Control 90 min | Treated 30 min |
| Wetness (° SR) | 17.0 | 17.5 | 33.5 | 33.5 |
| Beating time (min) | — | — | 27.0 | 22.0 |
| Tensile index (N m/g) | 39.75 | 43.65 | 68.89 | 70.52 |
| Breaking length (m) | 4055 | 4453 | 7026 | 7193 |
| Burst index (kN/g) | 1.94 | 2.18 | 4.59 | 4.79 |
| Tear index (mN $m^2$/g) | 6.73 | 7.03 | 7.75 | 8.14 |
| Double fold (No.) | 7 | 11 | 58 | 58 |

Treatment of eucalyptus with *C. subvermispora* L-14801-SS-3 for 2 weeks
Time to cooking temperature was fixed at 90 min and time at cooking temperature was reduced.
Treatment for eucalyptus with *C. subvermispora* L-14807-SS-3 for 2 weeks, Inoculum level 5 g/T wood.
Treatment of eucalyptus with *C. subvermispora* L-14807-SS-3 for 2 weeks, inoculum level 5g/T wood.

TABLE 4

Effect of fungal treatment on sulfidity requirement in cooking

| | Control | | Treated | |
|---|---|---|---|---|
| Parameter | 22.9% S | 16% S | 16% S | 22.9% S |
| P. No | 13.71 | 14.16 | 14.16 | 13.82 |
| Unbleached brightness (% PV) | 28.9 | 28.0 | 30.3 | 31.2 |
| Unbleached pulp yield (%) | 46.2 | 45.6 | 45.4 | 45.1 |
| Wetness(° SR) | 17.5 | 17.5 | 18.0 | 18.0 |
| Tensile index (N m/g) | 35.71 | 33.91 | 41.79 | 42.10 |
| Breaking length (m) | 3642 | 3458 | 4262 | 4293 |
| Burst index (kN/g) | 1.55 | 1.32 | 1.81 | 2.01 |
| Tear index (mN$m^2$/g) | 5.69 | 5.35 | 6.90 | 6.12 |
| Double fold (No.) | 5 | 4 | 8 | 9 |

Treatment of eucalyptus chips with *C. subvermispora* for L-14807-SS-3 for 2 weeks, Inoculum level, 5 g/T wood.
Cooking conditions: 17% AA as $Na_2O$, 165° C., time to cooking temp. 90 min., Time at cooking temp. 90 min.

TABLE 5

Biokraft pulping of eucalyptus with *C.subvermispora* CZ-3 at reduced active alkali charge a. Pulp properties

| | AA charge (%) | | | |
|---|---|---|---|---|
| Parameter | 17 Control | 14 Treated | 14 Control | 14 Treated |
| P. No. | 13.54 | 16.41 | 16.04 | 16.41 |
| Unbleached brightness (% PV) | 28.4 | 28.8 | 28.2 | 28.8 |
| Unbleached pulp yield (%) | 46.20 | 45.55 | 47.61 | 45.55 |
| Final brightness (% PV) | 87.7 | 87.8 | 88.7 | 89.3 |
| Bleach chemical consumption (kg/TP) | | | | |
| Elemental $Cl_2$ | 37.6 | 37.6 | 45.3 | 45.3 |
| NaOH | 19.2 | 19.2 | 19.0 | 19.0 |
| Hypo | 13.9 | 13.9 | 13.2 | 13.2 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 35.5 | 35.0 |
| Beating time (min) | — | — | — | 28.5 | 20.5 |
| Tensile index (N m/g) | 36.02 | 43.63 | 44.65 | 74.64 | 76.34 |
| Breaking length (m) | 3674 | 4452 | 4554 | 7614 | 7788 |
| Burst index (kN/g) | 1.54 | 1.85 | 2.40 | 5.06 | 5.22 |
| Tear,index (mN $m^2$/g) | 6.98 | 7.01 | 7.76 | 7.90 | 8.19 |
| Double fold (No.) | 6 | 10 | 11 | 93 | 115 |

Treatment of eucalyptus with *C. subvermispora* CZ-3 for 2 weeks, Inoculum level, 5 g/T wood
Cooking of fungal-treated chips conducted at 14% AA charge; cooking of reference chips conducted at 17% and 14% AA charge

TABLE 6

Biokraft pulping of eucalyptus with *C. subvermispora* L-9186-SP at reduced active alkali charge a. Pulp properties

| | AA charge (%) | | | |
|---|---|---|---|---|
| Parameter | 17 Control | 14 Treated | 14 Control | 14 Treated |
| P. No. | 13.89 | 16.25 | 16.42 | 16.25 |
| Unbleached pulp yield (%) | 46.10 | 46.85 | 47.13 | 46.85 |
| Unbleached brightness (% PV) | 27.8 | 28.9 | 27.7 | 28.9 |
| Final brightness (% PV) | 88.7 | 89.5 | 89.4 | 90.6 |
| Bleach chemical consumption (kg/TP) | | | | |
| Elemental $Cl_2$ | 38.6 | 38.6 | 46.6 | 46.6 |
| NaOH | 19.1 | 19.1 | 16.8 | 18.8 |

TABLE 6-continued

Biokraft pulping of eucalyptus with *C. subvermispora* L-9186-SP at reduced active alkali charge

| | | | | | |
|---|---|---|---|---|---|
| Hypo | | 13.4 | 13.4 | 12.3 | 12.3 |
| Chlorine dioxide | | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 16.0 | 16.0 | 16.5 | 36.5 | 36.5 |
| Beating time (min) | — | — | — | 23.0 | 19.0 |
| Tensile index (N m/g) | 35.95 | 38.32 | 42.31 | 70.22 | 70.61 |
| Breaking length (m) | 3667 | 3908 | 4316 | 7163 | 7202 |
| Burst index (kN/g) | 1.67 | 1.78 | 1.93 | 4.48 | 5.21 |
| Tear index (nM $m^2$/g) | 6.49 | 7.06 | 7.31 | 7.69 | 7.87 |
| Double fold (No.) | 7 | 8 | 10 | 65 | 90 |

Treatment of eucalyptus with *C. subvermispora* L-9186-SP for 2 weeks, Inoculum level, 5 g/T wood
Cooking of fungal-treated chips conducted at 14% AA charge; cooking of reference chips conducted at 17% and 14% AA charge

TABLE 7

Biokraft pulping of eucalyptus with *C. subvermispora* FP-105752 at reduced active alkali charge a. Pulp properties

| | AA charge (%) | | | |
|---|---|---|---|---|
| Parameter | 17 Control | 14 Treated | 14 Control | 14 Treated |
| P. No. | 14.25 | 16.89 | 16.65 | 16.89 |
| Unbleached pulp yield (%) | 45.98 | 46.41 | 47.67 | 46.41 |
| Unbleached brightness (% PV) | 28.8 | 28.8 | 28.4 | 28.8 |
| Final brightness (% PV) | 88.0 | 89.2 | 89.2 | 90.0 |
| Bleach chemical consumption (kg/TP) | | | | |
| Elemental $Cl_2$ | 39.7 | 39.7 | 47.4 | 47.4 |
| NaOH | 18.8 | 18.8 | 18.4 | 18.4 |
| Hypo | 12.3 | 12.3 | 10.9 | 10.9 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 16.5 | 16.5 | 17.0 | 35.0 | 35.0 |
| Beating time (min) | — | — | — | 29.5 | 20.0 |
| Tensile index (N m/g) | 33.29 | 41.49 | 42.14 | 71.58 | 72.98 |

TABLE 7-continued

Biokraft pulping of eucalyptus with *C. subvermispora* FP-105752 at reduced active alkali charge

| | | | | | |
|---|---|---|---|---|---|
| Breaking length (m) | 3395 | 4232 | 4298 | 7301 | 7444 |
| Burst index (kN/g) | 1.70 | 1.98 | 2.01 | 4.90 | 5.25 |
| Tear index (mN $m^2$/g) | 6.01 | 6.28 | 6.25 | 7.88 | 8.13 |
| Double fold (No.) | 6 | 8 | 12 | 88 | 126 |

TABLE 8

Biokraft pulping of eucalyptus with *C. subvermispora* FP-105752-SS-5 at reduced active alkali charge a. Pulp properties

| | AA charge (%) | | | |
|---|---|---|---|---|
| Parameter | 17 Control | 14 Treated | 14 Control | 14 Treated |
| P. No. | 13.91 | 16.51 | 16.37 | 16.51 |
| Unbleached pulp yield (% PV) | 46.49 | 46.42 | 47.74 | 46.42 |
| Unbleached brightness (% PV) | 28.6 | 29.0 | 28.5 | 29.0 |
| Final brightness (% PV) | 86.9 | 87.5 | 87.8 | 88.9 |
| Bleach chemical consumption (kg/TP) | | | | |
| Elemental $Cl_2$ | 38.7 | 38.7 | 46.4 | 46.4 |
| NaOH | 19.5 | 19.5 | 19.4 | 19.4 |
| Hypo | 14.9 | 14.9 | 14.6 | 14.6 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 16.5 | 16.0 | 17.0 | 35.0 | 35.5 |
| Beating time (min) | — | — | — | 26.0 | 19.0 |
| Tensile index (N m/g) | 37.60 | 40.10 | 41.00 | 69.50 | 79.10 |
| Breaking length (m) | 3835 | 4090 | 4183 | 7089 | 8069 |
| Burst index (kN/g) | 1.64 | 1.84 | 1.96 | 4.88 | 5.34 |
| Tear index (mN $m^2$/g) | 6.54 | 6.80 | 6.55 | 8.71 | 7.88 |
| Double fold (No.) | 6 | 7 | 10 | 82 | 93 |

Treatment of eucalyptus with *C. subvermispora* FP-105752-SS-5 for 2 weeks, Inoculum level, 5 g/T wood
Cooking of fungal-treated chips conducted at 14% AA charge; cooking of reference chips conducted at 17% and 14% AA charge

TABLE 9

Biokraft pulping of eucalyptus with *Phlebia brevispora* at reduced active alkali charge a. Pulp properties

| Parameter | AA charge (%) 17 Control | 14 Treated | 14 Control | 14 Treated |
|---|---|---|---|---|
| P. No. | 13.06 | 16.11 | 15.62 | 15.9 |
| Unbleached pulp yield (%) | 45.80 | 45.10 | 46.50 | 45.30 |
| Unbleached brightness (% PV) | 27.6 | 28.7 | 27.0 | 27.5 |
| Final brightness (% PV) | 87.4 | 88.4 | 88.1 | 89.2 |
| Bleach chemical consumption (kg/TP) | | | | |
| Elemental $Cl_2$ | 36.3 | 36.3 | 43.9 | 43.9 |
| NaOH | 19.9 | 19.9 | 19.7 | 19.7 |
| Hypo | 14.7 | 14.7 | 13.8 | 13.8 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 35.5 | 35.5 |
| Beating time (min) | — | — | — | 26.0 | 21.0 |
| Tensile index (N m/g) | 36.02 | 43.63 | 44.65 | 74.64 | 76.34 |
| Breaking length (m) | 3674 | 4452 | 4554 | 7614 | 7788 |
| Burst index (kN/g) | 1.70 | 1.95 | 2.30 | 4.95 | 5.16 |
| Tear index (mN $m^2$/g) | 6.89 | 7.06 | 7.31 | 7.69 | 7.87 |
| Double fold (No.) | 6 | 10 | 11 | 93 | 115 |

Treatment of eucalyptus with *Phlebia brevispora* for 2 weeks, Inoculum level, 5 g/T wood
Cooking of fungal-treated chips conducted at 14% AA charge; cooking of reference chips conducted at 17% and 14% AA charge

TABLE 10

Biokraft pulping of eucalyptus with *Hyphodontia setulosa* at reduced active alkali charge a. Pulp properties

| Parameter | AA charge (%) 17 Control | 14 Treated | 14 Control | 14 Treated |
|---|---|---|---|---|
| P. No. | 13.39 | 15.50 | 16.37 | 15.90 |
| Unbleached brightness (% PV) | 27.9 | 29.0 | 27.1 | 29.0 |
| Unbleached pulp yield (%) | 45.92 | 45.75 | 47.01 | 46.10 |
| Final brightness (% PV) | 87.5 | 88.9 | 88.6 | 89.9 |
| Bleach chemical consumption (kg/TP) | | | | |
| Elemental $Cl_2$ | 37.2 | 37.2 | 46.4 | 46.4 |
| NaOH | 20.0 | 20.0 | 19.6 | 19.6 |
| Hypo | 16.7 | 16.7 | 12.3 | 12.3 |
| Chlorine dioxide | 6.0 | 6.0 | 6.0 | 6.0 |

TABLE 10-continued

Biokraft pulping of eucalyptus with *Hyphodontia setulosa* at reduced active alkali charge b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 35.5 | 35.5 |
| Beating time (min) | — | — | — | 28.0 | 22.0 |
| Tensile index (N m/g) | 37.60 | 40.10 | 41.00 | 69.50 | 79.10 |
| Breaking length (m) | 3835 | 4090 | 4183 | 7089 | 8069 |
| Burst index (kN/g) | 1.60 | 1.85 | 2.20 | 5.06 | 5.22 |
| Tear index (mN $m^2$/g) | 6.90 | 7.01 | 7.69 | 7.90 | 8.06 |
| Double fold (No.) | 6 | 9 | 11 | 91 | 110 |

Treatment of eucalyptus with *Hyphodontia setulosa* for 2 weeks, Inoculum level, 5 g/T wood
Cooking of fungal-treated chips conducted at 14% AA charge; cooking of reference chips conducted at 17% and 14% AA charge

TABLE 11

Biokraft pulping of eucalyptus with *Phlebia subserialis* at reduced active alkali charge a. Pulp properties

| Parameter | AA Charge (%) 17 Control | 14 Treated | 14 Control | 14 Treated |
|---|---|---|---|---|
| P. No. | 13.50 | 15.90 | 16.20 | 15.90 |
| Unbleached brightness (% PV) | 27.1 | 28.1 | 27.3 | 28.4 |
| Unbleached pulp yield (%) | 45.60 | 45.00 | 46.90 | 45.80 |
| Final brightness (% PV) | 87.4 | 88.5 | 88.3 | 89.5 |
| Bleach chemical consumption (kg/TP) | | | | |
| Elemental $Cl_2$ | 37.5 | 37.5 | 46.0 | 46.0 |
| NaOH | 20.1 | 20.1 | 19.8 | 19.8 |
| Hypo | 14.6 | 14.6 | 12.6 | 12.6 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 36.0 | 36.0 |
| Beating time (min) | — | — | — | 26.0 | 20.5 |
| Tensile index (N m/g) | 36.60 | 43.93 | 48.06 | 72.29 | 72.18 |

TABLE 11-continued

Biokraft pulping of eucalyptus with *Phlebia subserialis* at reduced active alkali charge

| | | | | | |
|---|---|---|---|---|---|
| Breaking length (m) | 3733 | 4481 | 4902 | 7374 | 7362 |
| Burst index (kN/g) | 1.65 | 1.96 | 2.20 | 4.58 | 4.64 |
| Tear index (mN $m^2$/g) | 6.10 | 7.3 | 7.60 | 7.71 | 8.42 |
| Double fold (No.) | 6 | 10 | 14 | 72 | 97 |

Treatment of eucalyptus with *Phlebia subserialis* for 2 weeks, Inoculum level, 5 g/T wood Cooking of fungal-treated chips conducted at 14% AA charge; cooking of reference chips conducted at 17% and 14% AA charge

TABLE 12

Biokraft pulping of eucalyptus with *Phlebia tremellosa* at reduced active alkali charge a. Pulp properties

| | AA charge (%) | | | |
|---|---|---|---|---|
| Parameter | 17 Control | 14 Treated | 14 Control | 14 Treated |
| P. No. | 13.89 | 15.90 | 16.00 | 16.30 |
| Unbleached brightness (% PV) | 28.6 | 29.7 | 28.0 | 28.8 |
| Unbleached pulp yield (%) | 46.00 | 45.50 | 46.90 | 45.80 |
| Final brightness (% PV) | 87.5 | 88.6 | 88.4 | 89.4 |
| Bleach chemical consumption (kg/TP) | | | | |
| Elemental $Cl_2$ | 38.6 | 38.6 | 45.3 | 45.3 |
| NaOH | 19.1 | 19.1 | 19.0 | 19.0 |
| Hypo | 13.4 | 13.4 | 13.2 | 13.2 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 35.0 | 35.0 |
| Beating time (min) | — | — | — | 25.0 | 21.0 |
| Tensile index (N m/g) | 37.60 | 40.10 | 41.00 | 69.50 | 79.10 |
| Breaking length (m) | 3835 | 4090 | 4183 | 7089 | 8069 |
| Burst index (kN/g) | 1.64 | 1.84 | 1.92 | 4.88 | 5.34 |
| Tear index (mN $m^2$/g) | 6.54 | 6.80 | 6.55 | 7.80 | 8.10 |
| Double fold (No.) | 6 | 7 | 10 | 82 | 93 |

Treatment of eucalyptus with *Phlebia tremellosa* for 2 weeks, Inoculum level, 5 g/T wood Cooking of fungal-treated chips conducted at 14% AA charge; cooking of reference chips conducted at 17% and 14% AA charge

TABLE 13

Biokraft pulping of eucalyptus with *Phanerochaete chrysosporium* at reduced active alkali charge a. Pulp properties

| | AA charge (%) | | | |
|---|---|---|---|---|
| Parameter | 17 Control | 14 Treated | 14 Control | 14 Treated |
| P. No. | 13.54 | 16.09 | 16.20 | 15.90 |
| Unbleached brightness (% PV) | 27.1 | 28.2 | 27.3 | 28.6 |
| Unbleached pulp yield (%) | 45.30 | 46.51 | 46.90 | 46.30 |
| Final brightness (% PV) | 86.6 | 88.0 | 87.8 | 89.0 |
| Bleach chemical consumption (kg/TP) | | | | |
| Elemental Cl | 37.6 | 37.6 | 46.0 | 46.0 |
| NaOH | 19.3 | 19.3 | 19.8 | 19.8 |
| Hypo | 14.1 | 14.1 | 12.6 | 12.6 |
| Chlorine dioxide | 6.0 | 6.0 | 6.0 | 6.0 |

b. Strength properties

| | Unbleached | | | Bleached | |
|---|---|---|---|---|---|
| | Control | | Treated | Control | Treated |
| Parameter | 17% AA | 14% AA | 14% AA | 17% AA | 14% AA |
| Wetness (° SR) | 17.0 | 17.0 | 17.5 | 35.0 | 35.0 |
| Beating time (min) | — | — | — | 26.0 | 21.0 |
| Tensile index (N m/g) | 36.02 | 42.31 | 44.65 | 74.64 | 76.34 |
| Breaking length (m) | 3674 | 4316 | 4554 | 7614 | 7788 |
| Burst index (kN/g) | 1.64 | 1.84 | 1.96 | 4.95 | 5.16 |
| Tear index (mN $m^2$/g) | 6.80 | 7.01 | 7.69 | 7.70 | 8.20 |
| Double fold (No.) | 6 | 9 | 12 | 84 | 100 |

Treatment of eucalyptus with *Phanerochaete chrysosporium* at 39° C. for 2 weeks, Inoculum level, 5 g/T wood Cooking of fungal-treated chips conducted at 14% AA charge; cooking of reference chips conducted at 17% and 14% AA charge

We claim:

1. A method for producing paper pulp for use in the making of paper from eucalyptus wood chips, comprising the steps of:

a) inoculating the wood chips with white rot fungus *C. subvermispora;* b) fermenting the wood chips so as to cause a propagation of the fungus through the wood chips and allow the fungus to modify the lignin; and c) pulping the degraded wood chips by a known kraft process.

2. A method as claimed in claim 1 together with the further step of bleaching the kraft pulp by a known bleaching process.

3. A method as claimed in claim 1 wherein the fermentation step is a static fermentation step.

4. A method as claimed in claim 1 wherein the *C. subvemispora* is a strain selected from the group consisting of: L-14807-SS-3, CZ-3, FP-105752-SS-5, FP-10572 and L-9186-SP.

5. The method of claim 1 wherein no nutrients are added.

6. A method as claimed in claim 1 wherein the wood chips are inoculated with the fungus and known nutrients.

7. A method as claimed in claim 1 wherein the moisture content of the chips prior to the step of inoculation is kept at fibre saturation point or greater.

8. A method as claimed in claim 1 wherein said moisture content is 50–55% of the total wood based on a wet weight of the chips.

9. A method as claimed in claim 1 wherein the wood chips are inoculated with 1 to 5 gms inoculum/ton of wood.

10. A method as claimed in claim 1 wherein the moisture content in the wood during the step of fermentation is 55–65%.

11. The method of claim 1, wherein no nutrients are added to the wood chips or fungi before, during or after the inoculation of the wood chips with white rot fungi.

12. The method of claim 1, wherein no nutrients are added to the wood chips or fungi before the inoculation of the wood chips with white rot fungi.

13. The method of claim 1, wherein no nutrients are added to the wood chips or fungi during the inoculation of the wood chips with white rot fungi.

14. The method of claim 1, wherein no nutrients are added to the wood chips or fungi after the inoculation of the wood chips with white rot fungi.

15. A method for producing paper pulp for use in the making of paper from eucalyptus wood chips comprising:

a) inoculating the wood chips with white rot fungus *C. subvermispora;* b) incubating the wood chips with the white rot fungi for a period of time;

c) fermenting the wood chips so as to cause a propagation of the fungus through the wood chips and allow the fungus to modify the lignin; and d) pulping the degraded wood chips by a known kraft process;

wherein no nutrients are added to the wood chips at any time.

* * * * *